US007887305B2

(12) United States Patent
Yajima

(10) Patent No.: US 7,887,305 B2
(45) Date of Patent: Feb. 15, 2011

(54) FLEXIBLE TANK AND A CHEMICAL LIQUID SUPPLY APPARATUS USING THE SAME

(75) Inventor: Takeo Yajima, Tokyo (JP)

(73) Assignee: Koganei Corporation, Tokyo (JP)

( * ) Notice: Subject to any disclaimer, the term of this patent is extended or adjusted under 35 U.S.C. 154(b) by 1108 days.

(21) Appl. No.: 11/113,608

(22) Filed: Apr. 25, 2005

(65) Prior Publication Data

US 2005/0238504 A1 Oct. 27, 2005

(30) Foreign Application Priority Data

Apr. 26, 2004 (JP) ..... 2004-130160

(51) Int. Cl.
*F04B 23/04* (2006.01)
*F04B 11/00* (2006.01)

(52) U.S. Cl. ..... 417/313; 417/540; 92/92; 138/30

(58) Field of Classification Search ..... 210/767, 210/194, 416.1, 472, 805, 138, 141, 143, 210/739; 417/2, 38, 44.1, 253, 254, 313, 417/426, 428, 540, 416.1; 92/92, 90, 91; 138/30

See application file for complete search history.

(56) References Cited

U.S. PATENT DOCUMENTS 4,256,187 A * 3/1981 Barnard ..... 173/202
4,268,005 A 5/1981 Raftis et al.
4,798,258 A * 1/1989 Otteson ..... 180/175
5,262,068 A * 11/1993 Bowers et al. ..... 210/767
5,490,765 A 2/1996 Bailey et al.
5,876,612 A * 3/1999 Astrom ..... 210/741
5,900,045 A * 5/1999 Wang et al. ..... 95/241
5,964,580 A * 10/1999 Taga ..... 417/394
6,125,882 A 10/2000 Kong ..... 137/558
6,171,367 B1 * 1/2001 Peng et al. ..... 95/46
6,183,223 B1 2/2001 Yajima
6,238,576 B1 * 5/2001 Yajima ..... 210/767

(Continued)

FOREIGN PATENT DOCUMENTS

CN 1424742 6/2003

(Continued)

OTHER PUBLICATIONS

Chinese Patent Office Action dated May 30, 2008.

(Continued)

*Primary Examiner*—Devon C Kramer
*Assistant Examiner*—Patrick Hamo
(74) *Attorney, Agent, or Firm*—McCormick, Paulding & Huber LLP

(57) ABSTRACT

A flexible tank has a volume-variable chamber formed so as to be sectioned by a flexible tube that is expanded or contracted in accordance with the amount of the contained chemical liquid, and adaptor parts attached to the flexible tube. A primary-side port open to the volume-variable chamber is open into one of the adaptor parts, and a secondary-side port open to the volume-variable chamber is open into the other adaptor part. The contact between the chemical liquid and air in the volume-variable chamber is suppressed to minimum level, thereby containing the chemical liquid without deteriorating the cleanliness of the chemical liquid, and improving discharge accuracy of the chemical liquid.

9 Claims, 13 Drawing Sheets

U.S. PATENT DOCUMENTS

| | | | | |
|---|---|---|---|---|
| 6,434,935 | B1 | 8/2002 | Rammhofer et al. | 60/585 |
| 6,539,986 | B2 * | 4/2003 | Yajima | 141/2 |
| 6,575,715 | B1 | 6/2003 | Rastegar | |
| 7,029,238 | B1 * | 4/2006 | Zagars et al. | 417/26 |
| 2002/0131875 | A1 | 9/2002 | Yajima | |

FOREIGN PATENT DOCUMENTS

| | | | |
|---|---|---|---|
| JP | 51-30181 | | 7/1976 |
| JP | 1155445 | | 10/1989 |
| JP | 7163854 | A | 6/1995 |
| JP | 8015076 | A | 1/1996 |
| JP | 8144990 | A | 6/1996 |
| JP | 9085148 | A | 3/1997 |
| JP | 10061558 | | 3/1998 |
| KR | 20010021281 | | 3/2001 |
| KR | 100310033 | B | 9/2001 |
| KR | 20040015966 | | 2/2004 |
| WO | WO2004/017150 | A1 | 2/2004 |

OTHER PUBLICATIONS

Office Action issued in corresponding Japanese Patent Application No. 2004-130160 dated Mar. 17, 2009 and its translation, (6 pages).
Office Action and from corresponding JP application No. 2004-130160 dated Oct. 6, 2009 (5 pages).

* cited by examiner

FLEXIBLE TANK AND A CHEMICAL LIQUID SUPPLY APPARATUS USING THE SAME

CROSS-REFERENCE TO RELATED APPLICATION

The present application claims priority from Japanese Patent Application JP 2004-130160 filed on Apr. 26, 2004, the content of which is hereby incorporated by reference into this application.

TECHNICAL FIELD OF THE INVENTION

The present invention relates to a flexible tank for containing a liquid such as a chemical liquid, and a chemical liquid supply apparatus using the same.

BACKGROUND OF THE INVENTION

Chemical liquids such as a photoresist liquid, a spin-on-glass liquid, a polyimide resin solution, purified water, a developing solution, an etching solution, and an organic solvent are used in the production processes in the technical fields including semiconductor wafer manufacturing techniques, liquid-crystal substrate manufacturing techniques, magnetic disk manufacturing techniques, and multi-layered wiring board manufacturing techniques; and chemical liquid supply apparatuses are used for application of the chemical liquids. For example, when a photoresist liquid is to be applied onto the surface of a semiconductor wafer, in a state in which the semiconductor wafer is placed on a horizontal plane and rotated, the photoresist liquid is dropped onto the surface of the semiconductor wafer. A chemical liquid tank is used as a device for containing the chemical liquid before dropping, and the chemical liquid tanks are differently used according to various objects.

For example, when a chemical liquid which has been filtrated through a filter is to be applied onto a wafer, in some cases, a filter is provided at the second side of a pump and the pump is actuated. At this point, the filtration speed and the discharge speed are the same. However, since the speed suitable for filtration and the speed suitable for application are normally different, the yield is sometimes reduced for the reason that, for example, air bubbles or gelled chemical liquid passes through the filter membrane. Thereat, there provided a case in which a filter is provided at the downstream of a first pump, a chemical liquid tank is provided in downstream of the filter, and a second pump is provided at the downstream of the chemical liquid tank, such that the first pump is subjected to a discharge operation, thereby temporarily storing the filtrated chemical liquid in the chemical liquid tank, and subsequently, the chemical liquid is sucked in by the second pump so as to apply it onto a wafer (for example, see, U.S. Pat. No. 5,490,765).

Meanwhile, when the replaceable chemical liquid tank (chemical liquid bottle) disposed at the uppermost streamside becomes empty, and when the chemical liquid supply apparatus is to be actuated even while the empty chemical liquid bottle is being replaced; there provided a case in which a chemical liquid tank for buffering is provided within the chemical liquid circuit, some of the chemical liquid in the chemical liquid bottle are stored therein in advance, and the chemical liquid contained in the chemical liquid tank for buffering is used as a substitute while the empty chemical liquid bottle is being replaced.

Meanwhile, in some cases, an application nozzle is provided about several meters above the chemical liquid tank disposed at the uppermost stream side of the chemical liquid circuit. In this case, when the chemical liquid in the chemical liquid tank is updrawn by one pump, the load imposed on the pump is excessive. Therefore, there provided a case in which an auxiliary tank and an auxiliary pump for relaying are provided within the chemical liquid circuit, such that the chemical liquid is updrawn to the auxiliary tank by the first pump, and subsequently, the chemical liquid in the auxiliary tank is updrawn to the application nozzle by use of the second pump.

When chemical liquid is dropped, the chemical liquid is reduced; therefore, the remaining amount of the chemical liquid in the chemical liquid tank has to be checked at appropriate timing. Until now, there known a method in which the remaining amount of the chemical liquid is checked by detecting the boundary face of air and chemical liquid, i.e., the level of the chemical liquid surface (liquid level) by a sensor. However, when a gas is mixed in the chemical liquid, the discharge amount becomes unstable since air bubbles absorb the supply pressure. Moreover, if the chemical liquid is the kind that is altered when it comes into contact with air, such as a photoresist liquid, the function of the chemical liquid is deteriorated, or the dropping amount of the chemical liquid becomes unstable, thereby deteriorating the yield of the product.

SUMMARY OF THE INVENTION

An object of the present invention is to provide a flexible tank that can contain a chemical liquid without deteriorating the cleanliness of the chemical liquid.

Another object of the present invention is to provide a chemical liquid supply apparatus that can improve discharge accuracy of the chemical liquid by use of the flexible tank.

A flexible tank of the present invention comprises: a volume-variable chamber formed so as to be sectioned by a flexible membrane which is expanded and contracted in accordance with the amount of a contained chemical liquid, and an adaptor part in which the flexible membrane is attached; and a primary-side port and a secondary-side port formed in the adaptor part so as to be open to the volume-variable chamber.

The flexible tank of the present invention is characterized in that deformation of the flexible membrane which is expansion or contraction is detected by a sensor so as to determine that a predetermined amount of the chemical liquid is contained in the volume-variable chamber.

The flexible tank of the present invention is characterized in that a compression chamber in which a pressure port is provided and the volume-variable chamber is accommodated is formed so as to be sectioned by a sealing part fixed to the adaptor part, and the adaptor part, and a predetermined fluid pressure is supplied from the pressure port to the compression chamber.

The flexible tank of the present invention is characterized in that a flexible tube one end of which being open to the primary-side port and the other end of which being open to the secondary-side port is used as the flexible membrane.

The flexible tank of the present invention is characterized in that a gas discharge port open to the volume-variable chamber is formed in the adaptor part, and a flexible tube of which one end being open to the gas discharge port and the other end being open to the primary-side port and the secondary-side port is used as the flexible membrane.

The flexible tank of the present invention is characterized in that a diaphragm or a bellows attached to the adaptor part so as to cover the primary-side port and the secondary-side port is used as the flexible membrane.

A chemical liquid supply apparatus of the present invention has a chemical liquid bottle containing a chemical liquid, and a pump for sucking in the chemical liquid contained in the chemical liquid bottle and supplying the chemical liquid to an application nozzle; the chemical liquid supply apparatus comprising: a buffer tank chamber that being expanded in accordance with the amount of the chemical liquid supplied from the chemical liquid bottle by compression transport, and being contracted in accordance with the amount of the chemical liquid sucked in by the pump, and a pressure chamber containing the buffer tank chamber and communicated with inside and outside via an atmospheric-air open port; wherein the volume of the buffer tank chamber is kept constant in a state in which the atmospheric-air open port is closed, and the buffer tank chamber is expanded or contracted in accordance with the amount of the contained chemical liquid in a state in which the atmospheric-air open port is open.

A chemical liquid supply apparatus having a chemical liquid bottle containing a chemical liquid of the present invention is characterized in a primary-side pump for sucking in the chemical liquid contained in the chemical liquid bottle, a filter for filtrating the chemical liquid sucked-in by the primary-side pump, and a secondary-side pump for supplying the chemical liquid filtrated through the filter to an application nozzle; the chemical liquid supply apparatus comprising: an adaptor part in which a primary-side port connected to the primary-side pump and a secondary-side port connected to the secondary-side pump are formed; and a flexible tank attached to the adaptor part and comprising a flexible tube being expanded in accordance with the amount of the chemical liquid flown in from the primary-side port, and being contracted in accordance with the amount of the chemical liquid flown out from the secondary-side port.

The chemical liquid supply apparatus of the present invention is characterized in that a gas discharge port is formed in the adaptor part, the flexible tube is attached to the adaptor such that one end of the tube is open to the gas discharge port and other end is open to the primary-side port and the secondary-side port, and the flexible tank is placed at the position higher than the chemical liquid bottle, the primary-side pump, the filter, and the secondary-side pump such that the gas discharge port is upwardly positioned.

The chemical liquid supply apparatus of the present invention is characterized in a buffer tank chamber being expanded in accordance with the amount of the chemical liquid supplied from the chemical liquid bottle by compression transport, and being contracted in accordance with the amount of the chemical liquid sucked-in by the primary-side pump; and a pressure chamber accommodating the buffer tank chamber and communicating with inside and outside via an atmospheric-air open port; wherein the volume of the buffer tank chamber is kept constant in a state in which the atmospheric-air open port is closed, and the buffer tank chamber is expanded or contracted in accordance with the amount of the contained chemical liquid in a state in which the atmospheric-air open port is open.

BRIEF DESCRIPTIONS OF THE DRAWINGS

DESCRIPTIONS OF THE PREFERRED EMBODIMENTS

Hereinafter, embodiments of the present invention will be described in detail based on drawings.

Figure 1A:
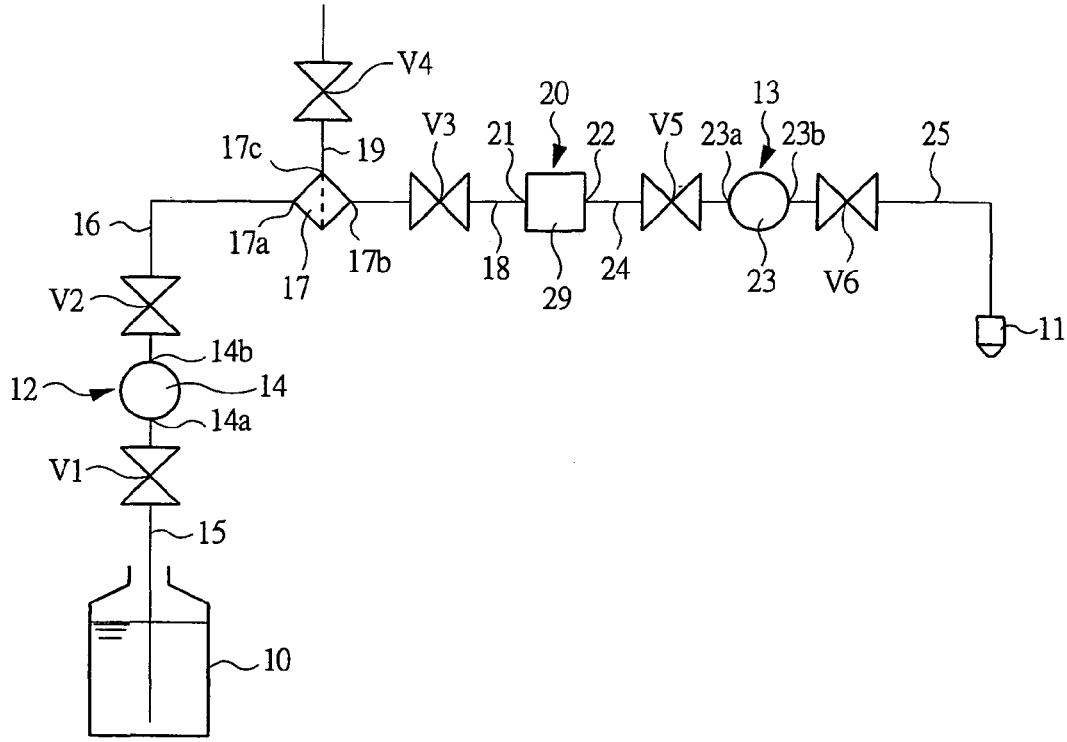
FIG. 1A is a chemical liquid circuit diagram schematically illustrating outline of a chemical liquid supply apparatus which is an embodiment of the present invention.
Figure 1B:
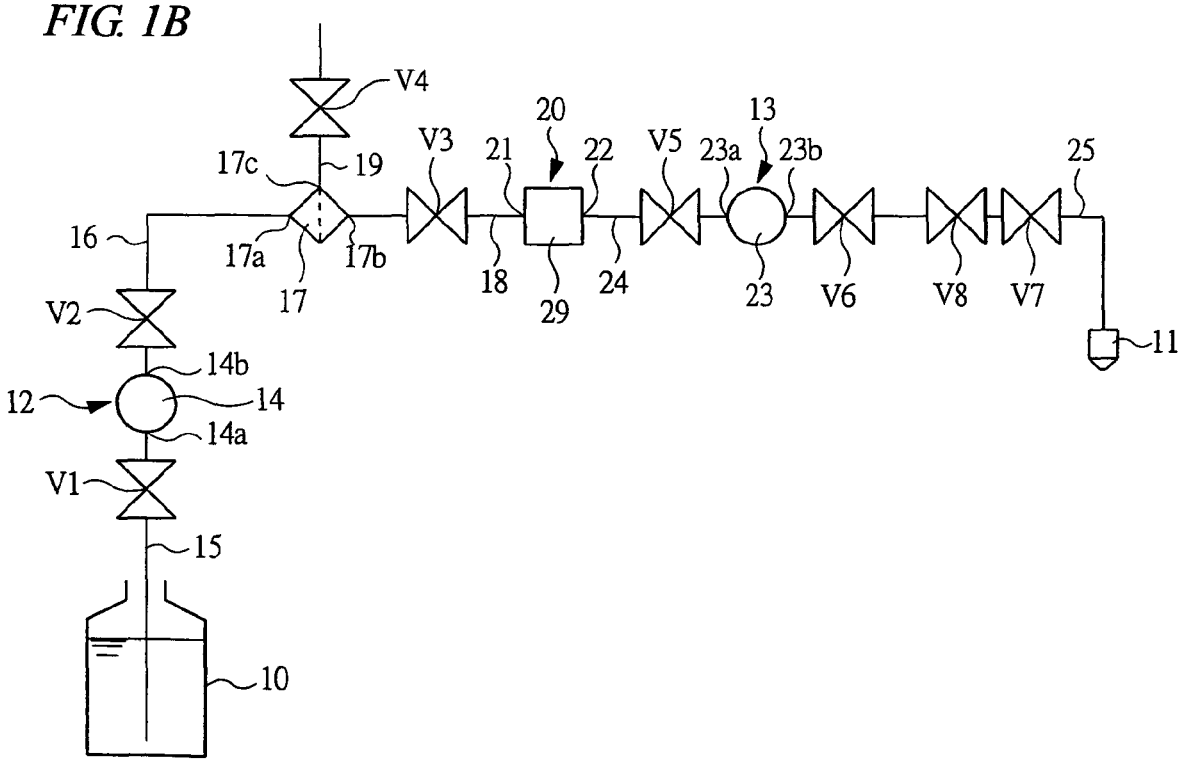
FIG. 1B is a chemical liquid circuit diagram schematically illustrating a modification example of the chemical liquid supply apparatus shown in FIG. 1A.

FIG. 1A is a chemical liquid circuit diagram schematically illustrating outline of a chemical liquid supply apparatus which is an embodiment of the present invention. FIG. 1B is a chemical liquid circuit diagram schematically illustrating a modification example of the chemical liquid supply apparatus shown in FIG. 1A. As shown in FIGS. 1A and 1B, a chemical liquid bottle 10 containing a chemical liquid is disposed at the uppermost stream side of the chemical liquid circuit, and an application nozzle (chemical liquid discharge member) 11 for discharging a chemical liquid to a wafer is disposed at the end of the stream of the chemical liquid circuit. In order to cause the application nozzle 11 to discharge the chemical liquid contained in the chemical liquid bottle 10, a primary-side pump 12 for sucking the chemical liquid contained in the chemical liquid bottle 10 is disposed at the upstream side of the chemical liquid circuit, and a secondary-side pump 13 for supplying the chemical liquid to the application nozzle 11 is disposed at the downstream side of the chemical liquid circuit.

The primary-side pump 12 comprises a pump chamber 14, and a suction valve V1 and a discharge valve V2 for opening and closing the fluid channel. A pump inlet 14*a* and a pump outlet 14*b* are open into the pump chamber 14, a chemical liquid introducing fluid channel 15 in which the suction valve V1 is provided is connected to the pump inlet 14*a*, and a communication fluid channel 16 in which the discharge valve V2 is provided is connected to the pump outlet 14*b*. The other end of the chemical liquid introducing fluid channel 15 is disposed so as to be positioned inside of the chemical liquid bottle 10, and the other end of the communication fluid channel 16 is connected to a filter inlet 17*a*.

When the suction valve V1 is open and the discharge valve V2 is closed so as to expand the volume of the pump chamber 14, the primary-side pump 12 sucks in the chemical liquid in the chemical bottle 10 into the pump chamber 14; and when the discharge valve V2 is open and the suction valve V1 is closed so as to reduce the volume of the pump chamber 14, the primary-side pump 12 supplies the chemical liquid in the pump chamber 14 to a filter 17.

An unillustrated filter membrane is accommodated in the filter 17, and when the chemical liquid flown in from the filter inlet 17*a* permeates the filter membrane and flows out from a filter outlet 17*b*, foreign substances such as a gas in the chemical liquid are captured on the surface of the film membrane. As the filter membrane, that formed of a hollow fiber membrane, or that formed of a sheet membrane is employed. However, as long as the membrane is able to filtrate a chemical liquid therethrough, the filter membrane is not limited to above described membranes. A communication fluid channel 18 in which an opening and closing valve V3 is provided is connected to the filter outlet 17*b*, and the chemical liquid exhibiting a high cleanliness flows into the communication fluid channel 18.

The filter 17 has a vent port 17*c*, and a gas discharge fluid channel 19 communicated with outside is connected to a vent port 17*c* via a deaerating valve V4 for opening and closing the fluid channel. These members are disposed for discharging the gas in the filter 17 to outside; and when the deaerating valve V4 is open, the gas contained in the chemical liquid is discharged to outside via the filter 17. The gas discharge fluid channel 19 may be connected to an unillustrated vacuum source, such that the gas is sucked in when the discharge valve V2 and the opening and closing valve V3 are closed and the vacuum source is actuated. As the vacuum source, a vacuum pump of a reciprocating type or a vane type, or an ejector can be employed.

Generally, the speed suitable for filtration and the speed suitable for application are different. Therefore, in order to cause the chemical liquid to permeate the filter 17 at a speed suitable for filtration, and then, to drop the chemical liquid at a speed suitable for application; a flexible tank 20 and the secondary-side pump 13 are disposed between the filter 17 and the application nozzle 11. More specifically, the chemical liquid discharged from the primary-side pump 12 at a speed suitable for filtration permeates the filter 17 and subjected to filtration, then, is temporarily contained in the flexible tank 20, and subsequently, is sucked in by the secondary-side pump 13 at a speed suitable for application and supplied toward the application nozzle 11.

The flexible tank 20 contains the chemical liquid that has been filtrated through the filter 17 and sucked in by the secondary-side pump 13. The other end of the communication fluid channel 18 is connected to a primary-side port 21 of the flexible tank 20, and it is designed such that the chemical liquid flows from a primary-side port 21 to inside of the flexible tank 20, and the chemical liquid contained in the flexible tank 20 flows out from a secondary-side port 22.

As well as the primary-side pump 12, the secondary-side pump 13 comprises a pump chamber 23, and a suction valve V5 and a discharge valve V6 for opening and closing the fluid channel. A pump inlet 23*a* and a pump outlet 23*b* are formed in the pump chamber 23, a chemical liquid introducing fluid channel 24 in which the suction valve V5 is provided is connected to the pump inlet 23*a*, and a discharge fluid channel 25 in which the discharge valve V6 is provided is connected to the pump outlet 23*b*. The other end of the chemical liquid introducing channel 24 is connected to the secondary-side port 22 of the flexible tank 20, and the application nozzle 11 is provided at the other end of the discharge fluid channel 25.

When the suction valve V5 is open and the discharge valve V6 is closed so as to expand the volume of the pump chamber 23, the secondary-side pump 13 can suck in the chemical liquid in the flexible tank 20 into the pump chamber 23; and when the discharge valve V6 is open and the suction valve V5 is closed so as to reduce the volume of the pump chamber 23, the chemical liquid in the pump chamber 23 can be supplied to the application nozzle 11. The application nozzle 11 is open toward an unillustrated wafer so as to discharge the chemical liquid onto the wafer.

As described above, the chemical liquid supply apparatus can carry out application of a chemical liquid such as a photoresist liquid by opening and closing the suction valves V1 to discharge valves V6 at the timing corresponding to expansion and contraction of the pump chambers 14 and 23 so as to open and close the respective fluid channels. As the primary-side pump 12 and the secondary-side pump 13, for example, the pump described in Japanese Patent Application Laid-Open (kokai) No. 1998-61558 which has been proposed by the present applicant can be used.

After application of the chemical liquid is finished, a so-called suckback operation can be performed. In the case shown in FIG. 1B, a suckback valve V7 for preventing dripping from the application nozzle 11 is disposed between the secondary-side pump 13 and the application nozzle 11. After a fluid is discharged from the application nozzle 11, the suckback valve V7 can be actuated such that the chemical liquid remaining in the application nozzle 11 is slightly drawn back, thereby preventing a droplet from dropping from the application nozzle 11. In accordance with needs, an application nozzle opening and closing valve V8 may be provided between the secondary-side pump 13 and the application nozzle 11.

Figure 2:
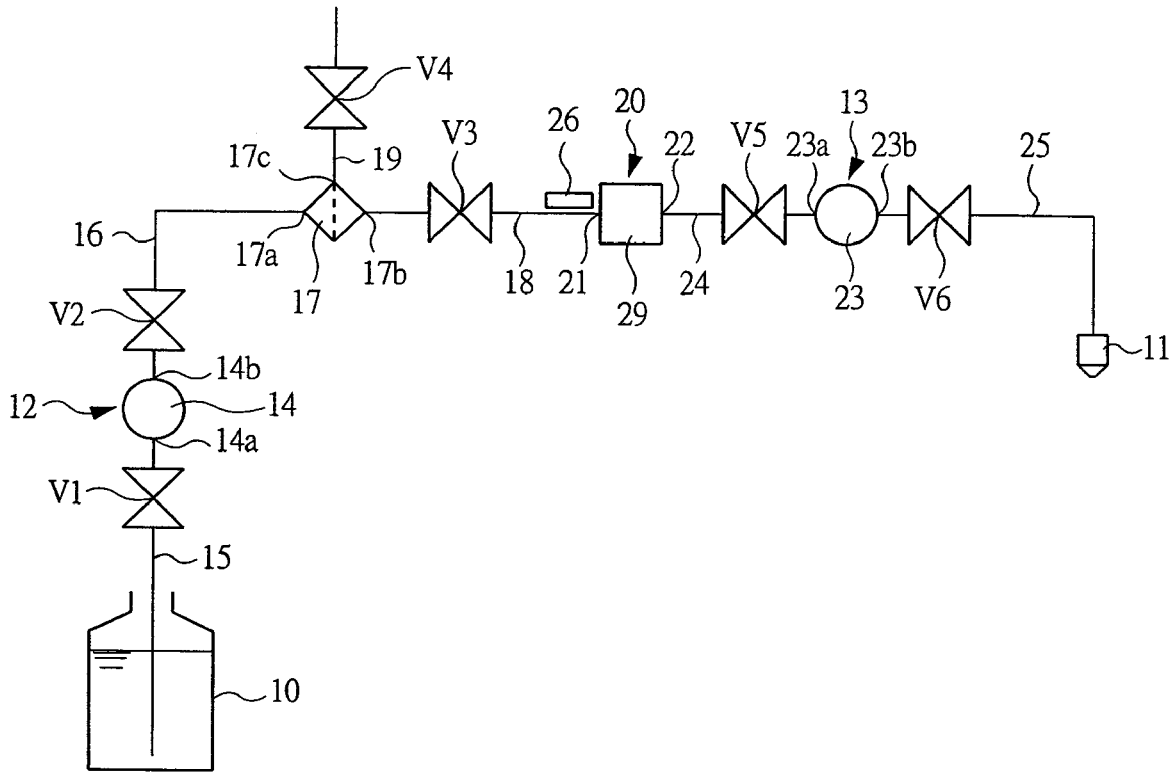
FIG. 2 is a chemical liquid circuit diagram schematically illustrating a modification example of the chemical liquid supply apparatus shown in FIG. 1A.
Figure 3A:
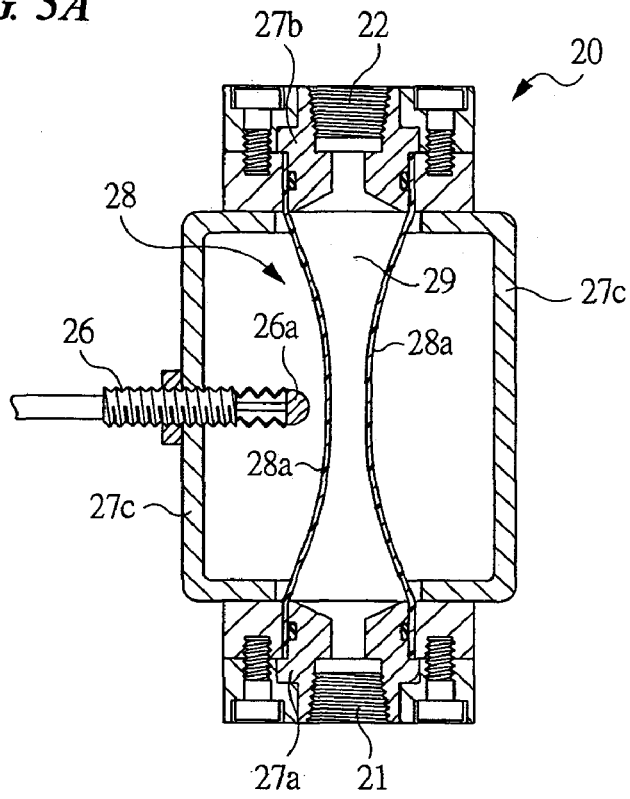
FIG. 3A and FIG. 3B are schematic cross sectional views illustrating the inner structure of a flexible tank.
Figure 3B:
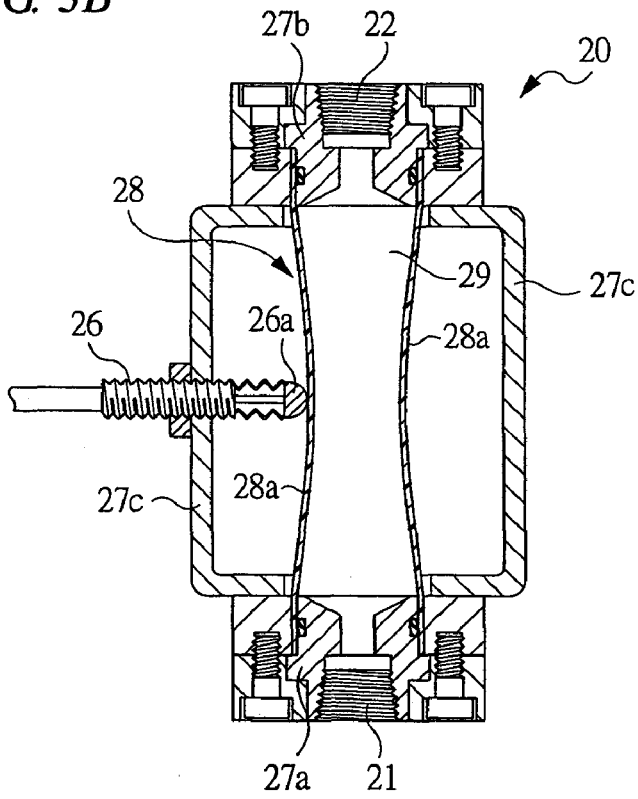

FIG. 2 is a chemical liquid circuit diagram schematically illustrating a modification example of the chemical liquid supply apparatus shown in FIG. 1A, and FIGS. 3A and 3B are schematic cross sectional views illustrating the inner structure of a flexible tank. In the case shown in FIG. 2 and FIGS. 3A and 3B, a sensor 26 for detecting the volume of the chemical liquid contained in the flexible tank 20 is incorporated in the flexible tank 20.

The flexible tank 20 has an adaptor part 27*a* in which the primary-side port 21 in which the chemical liquid flows is formed, an adaptor part 27*b* in which the secondary-side port 22 from which the chemical liquid flows out is formed, and a flexible membrane 28 which is attached to the adaptor parts 27*a* and 27*b*, and formed of an elastic material that expands in accordance with the volume of the chemical liquid flown in from the primary-side port 21, and contracts in accordance with the volume of the chemical liquid flown out from the secondary-side port 22. The adaptor parts 27*a* and 27*b* and the flexible membrane 28 sections thereat so as to form a volume-variable chamber 29, and the flexible membrane 28 is deformed in accordance with the amount of the chemical liquid contained in the volume-variable chamber 29.

When the chemical liquid contained in the chemical liquid bottle 10 is a photoresist liquid, the members such as the flexible membrane 28 and the adaptor parts 27*a* and 27*b* that come into contact with the chemical liquid are formed of tetrafluoroethylene-perfluoroalkylvinyl ether copolymer (PFA) that is a fluororesin, such that they do not react to the chemical liquid. However, the resin material is not limited to PFA, and other resin materials or metal materials may be employed.

In the case shown in FIGS. 3A and 3B, each of the adaptors 27*a* and 27*b* are connected by a connection part 27*c*. The connection part 27*c* that does not come into direct contact with the chemical liquid may be formed by, for example, by bending a sheet metal. The adaptor parts 27*a* and 27*b* and the connection parts 27*c* may be integrally formed, for example, by a resin material or a metal material.

In the case shown in FIG. 3, a flexible tube 28*a* of which one end is communicating with the primary-side port 21 and the other end is communicating with the secondary-side port 22 is employed as the flexible membrane 28. The flexible tube 28*a* is vertically disposed, the adaptor part 27*a* in which the primary-side port 21 is formed is attached to the bottom end of the tube, the adaptor part 27*b* in which the secondary-side port 22 is formed is attached to the upper end of the tube, and inside of the flexible tube 28 between both the adaptor parts 27*a* and 27*b* serves as the volume-variable chamber 29.

The flexible tube 28*a* expands and contracts in the radial direction, and the volume-variable chamber 29 expands and contracts in accordance with the amount of the chemical liquid contained therein (see, FIG. 3A and FIG. 3B). The sensor 26 for detecting deformation of the flexible tube 28*a* is screwed into the connection part 27*c* so as to be attached thereto.

The sensor 26 is a limit switch, and a contact part 26*a* provided at the front end of the sensor 26 is disposed toward the flexible tube 28*a*. As shown in FIG. 3B, when the outer peripheral side surfaces of the radially expanded flexible tube 28*a* comes into contact with the contact part 26*a*, the sensor detects that a predetermined amount of chemical liquid is contained in the flexible tank 20. The position of the contact part 26*a* in the radial direction with respect to the flexible tube 28*a* is adjustable in the radial direction, and the amount of the chemical liquid to be detected can be changed.

Figure 4A:
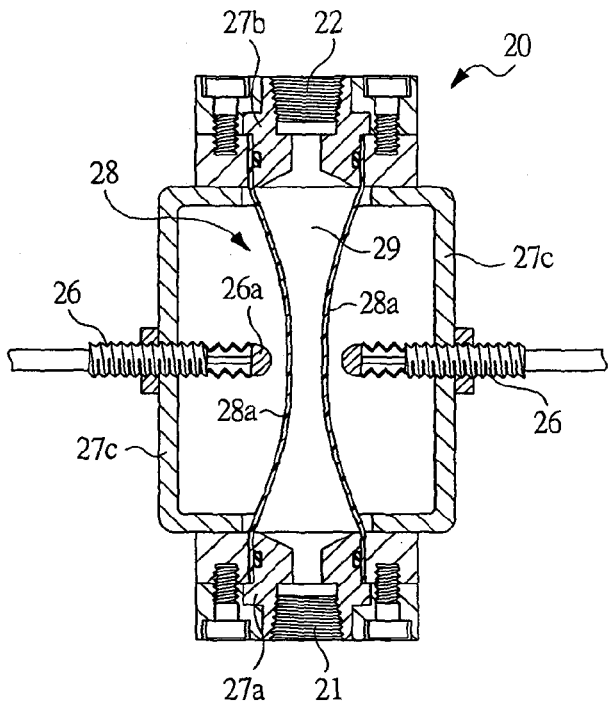
FIGS. 4A to 4C are schematic cross sectional views illustrating modification examples of the flexible tank shown in FIGS. 3A and 3B.
Figure 4B:
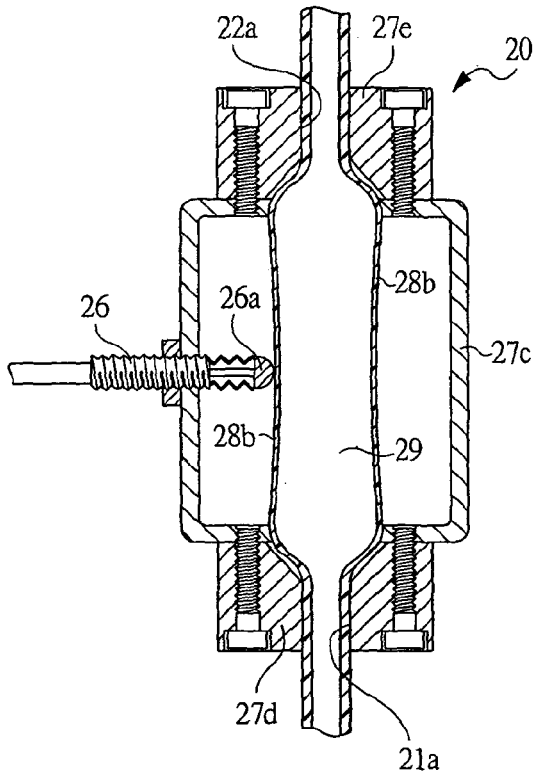
Figure 4C:
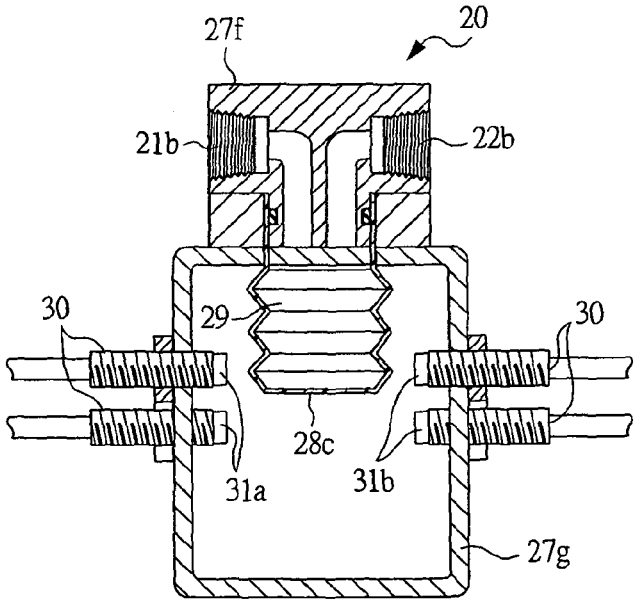

FIGS. 4A, 4B, and 4C are schematic cross sectional views illustrating modification examples of the flexible tank shown in FIGS. 3A and 3B. The members same as that shown in FIGS. 3A and 3B are denoted by the same reference numerals. As shown in FIG. 4A, a plurality of sensors 26 may be built in the connection part 27*c*. In the illustrated case, the sensors 26 same as the sensor 26 shown in FIGS. 3A and 3B are built in so as to sandwich the flexible tube 28*a*. When a plurality of the sensors 26 are built in, the positions of the contact parts 26*a* in the radial direction with respect to the flexible tube 28*a* may be individually set.

In the case shown in FIG. 4B, both ends of the flexible tube 28*b* are disposed so as to protrude from the primary-side port 21*a* formed in the adaptor part 27*d* and the secondary-side port 22*a* formed in the adaptor part 27*e*, respectively. In this case, the adaptor parts 27*d* and 27*e* that do not come into direct contact with the chemical liquid is not required to be formed of a resin material such as PFA. The communication fluid channel 18 and the chemical liquid introducing channel 24 may be integrally formed with the flexible tube 28*b* by employing a same resin material.

In the case shown in FIG. 4C, a bellows 28*c* attached to an adaptor part 27*f* covering the primary-side port 21*b* and the secondary-side port 22*b* is employed as the flexible membrane 28. The bellows 28*c* is vertically disposed so as to expand vertically downwardly in accordance with the amount of the chemical liquid supplied from the primary-side port 21*b*, and contract vertically upwardly in accordance with the amount of the chemical liquid flown out from the secondary-side port 22*b*. An unillustrated diaphragm may be employed instead of the bellows 28*c*.

In the case shown in FIG. 4C, photo-electric sensors 30 which is a type of non-contact sensors are built in a connection part 27*g*, so as to detect whether a predetermined amount of a chemical liquid is contained in the volume-variable chamber 29, by means of permeation or shut-off of the light irradiated from light-projecting heads 31*a* toward light-receiving heads 31*b*. When a plurality of photo-electric sensors 30 is built in at predetermined intervals along with the axial direction of the bellows 28*c* as shown in the drawing, the amount of a chemical liquid can be detected at different levels. As the sensor, the type that detects a refractive index of light, that detects the variation in electric capacitance, or that detects variation in ultrasonic may be employed.

Figure 5:
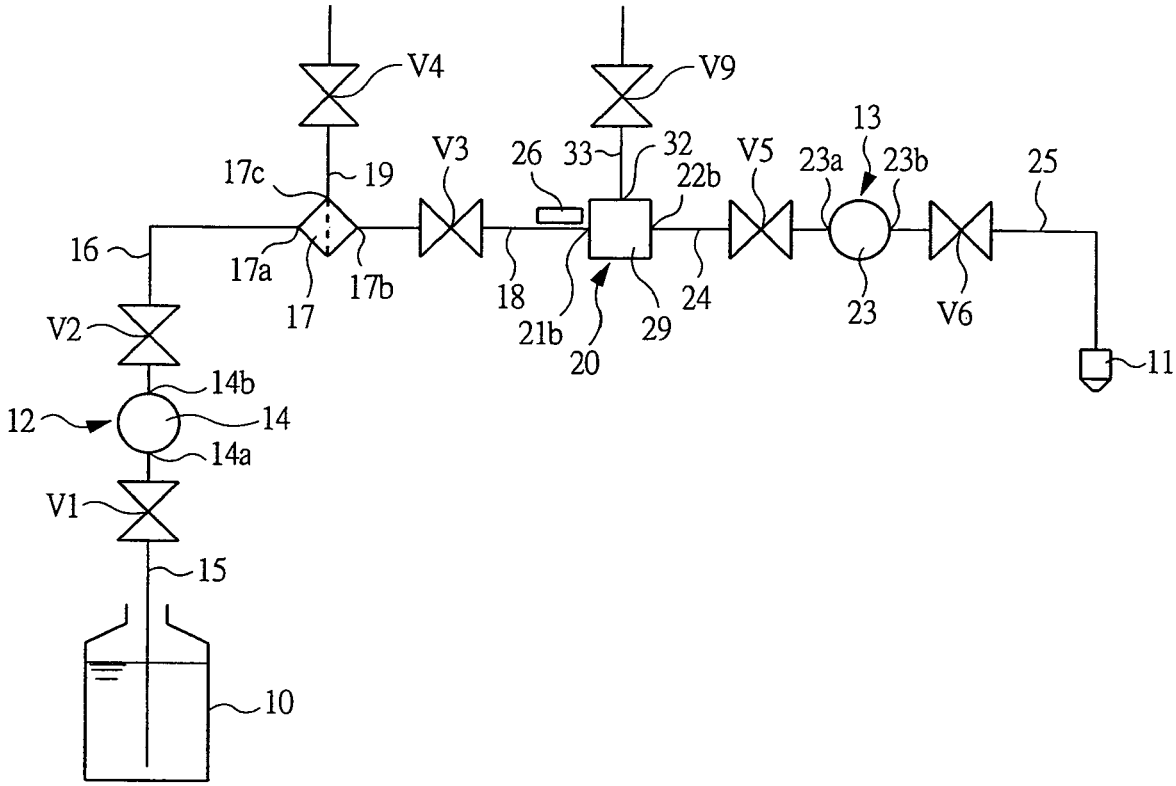
FIG. 5 is a chemical liquid circuit diagram schematically illustrating another modification example of the chemical liquid supply apparatus shown in FIG. 1A.
Figure 6:
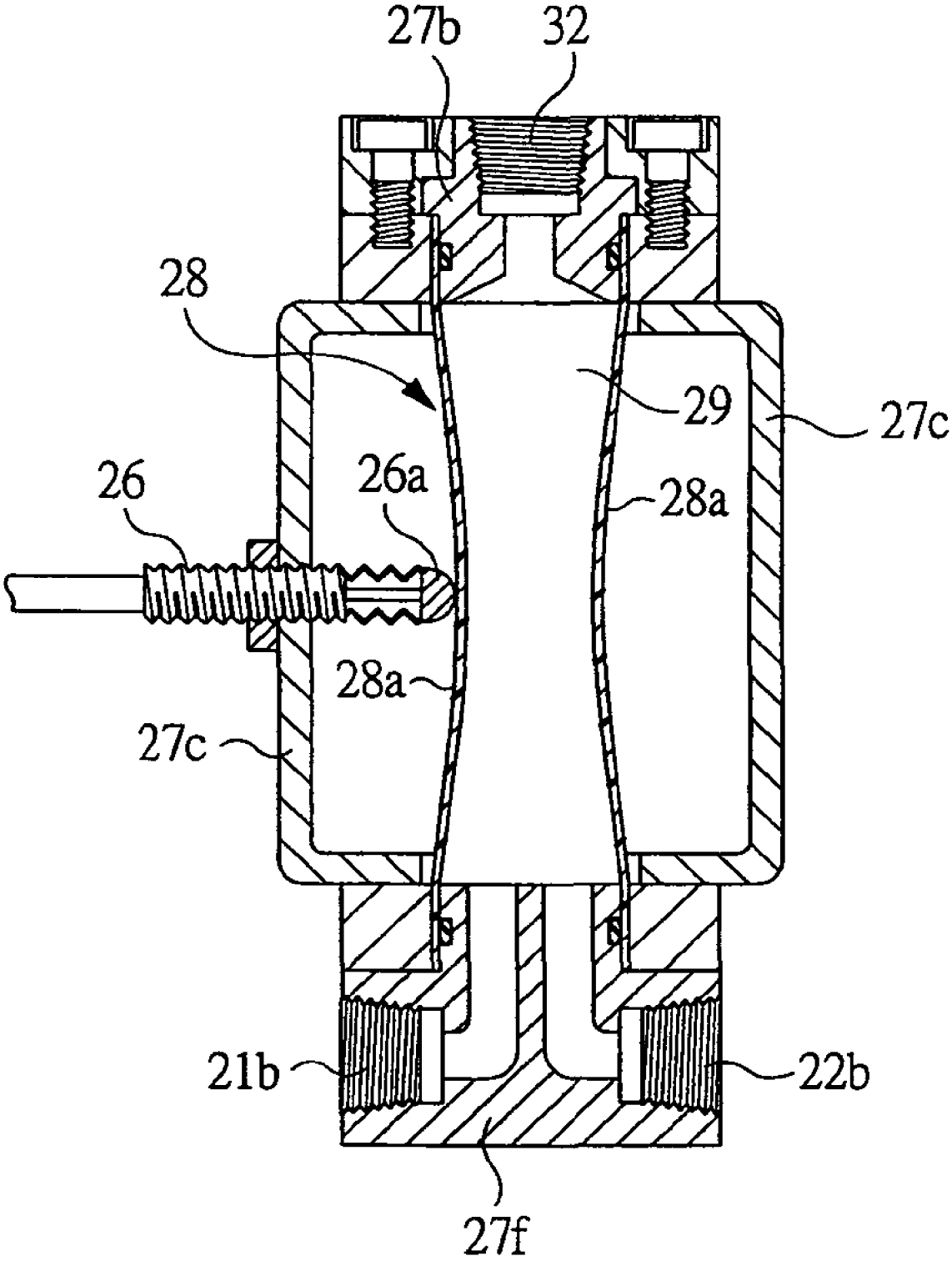
FIG. 6 is a schematic cross sectional view illustrating the inner structure of the flexible tank shown in FIG. 5.

FIG. 5 is a chemical liquid circuit diagram schematically illustrating another modification example of the chemical liquid supply apparatus shown in FIG. 1A; and FIG. 6 is a schematic cross sectional view illustrating the inner structure of the flexible tank shown in FIG. 5. The members same as the above described members are denoted by the same reference numerals.

A gas discharge port 32 open to the volume-variable chamber 29 is formed in the adaptor part 27*b*. The flexible tube 28*a* is vertically disposed, and the adaptor part 27*f* in which the primary-side port 21*b* and the secondary-side port 22*b* are formed is attached to the bottom end of the tube, and the adaptor part 27*b* in which the gas discharge port 32 is formed is attached to the upper end of the tube. Since the specific gravity of the gas flown from the primary-side port 21*b* into the volume-variable chamber 29 together with the chemical liquid has a small specific gravity compare with the chemical liquid, the gas is not flown out from the secondary-side port 22*b* provided at the bottom end, and gradually moves upwardly in the volume-variable chamber 29.

A gas discharge fluid channel 33 communicating with outside is connected to the gas discharge port 32 via a deaerating valve V9 for opening and closing the fluid channel. The air contained in the chemical liquid contained in the volume-variable chamber 29 can be discharged from the gas discharge port 32 to outside. As well as the filter 17, an unillustrated vacuum source may be connected to the gas discharge fluid channel 33, such that the gas is sucked in when the opening and closing valve V3 and the suction valve V5 are closed and the vacuum source is actuated. The vacuum source may be shared by connecting the gas discharge fluid channel 33 with the gas discharge fluid channel 19.

The flexible tube 28*a* is an elastic member, and a pressure is applied to the chemical liquid contained therein in accordance with the amount of deformation. Therefore, along with the increase in the amount of the chemical liquid contained in the volume-variable chamber 29, the supply pressure of the primary-side pump 12 is increased, while the suction pressure of the secondary-side pump 13 is reduced; and along with the reduction in the amount of the chemical liquid contained in the volume-variable chamber 29, the supply pressure of the primary-side pump 12 is reduced, while the suction pressure of the secondary-side pump 13 is increased. When the supply pressure and the suction pressure for the chemical liquid with respect to the volume-variable chamber 29 is changed in accordance with the amount of the chemical liquid contained in the volume-variable chamber 29 as described above, constantly supplying a predetermined amount of a chemical liquid to the secondary-side pump 13 becomes difficult, and variation is caused in the amount discharged from the application nozzle 11.

Thereat, when the pressure applied to the chemical liquid from the flexible tube 28*a* is maintained constant, regardless of the amount of the chemical liquid contained in the volume-variable chamber 29; the variation in the supply pressure of the primary-side pump 12 and the suction pressure of the secondary-side pump 13 with respect to the flexible tank 20 can be suppressed.

Figure 7:
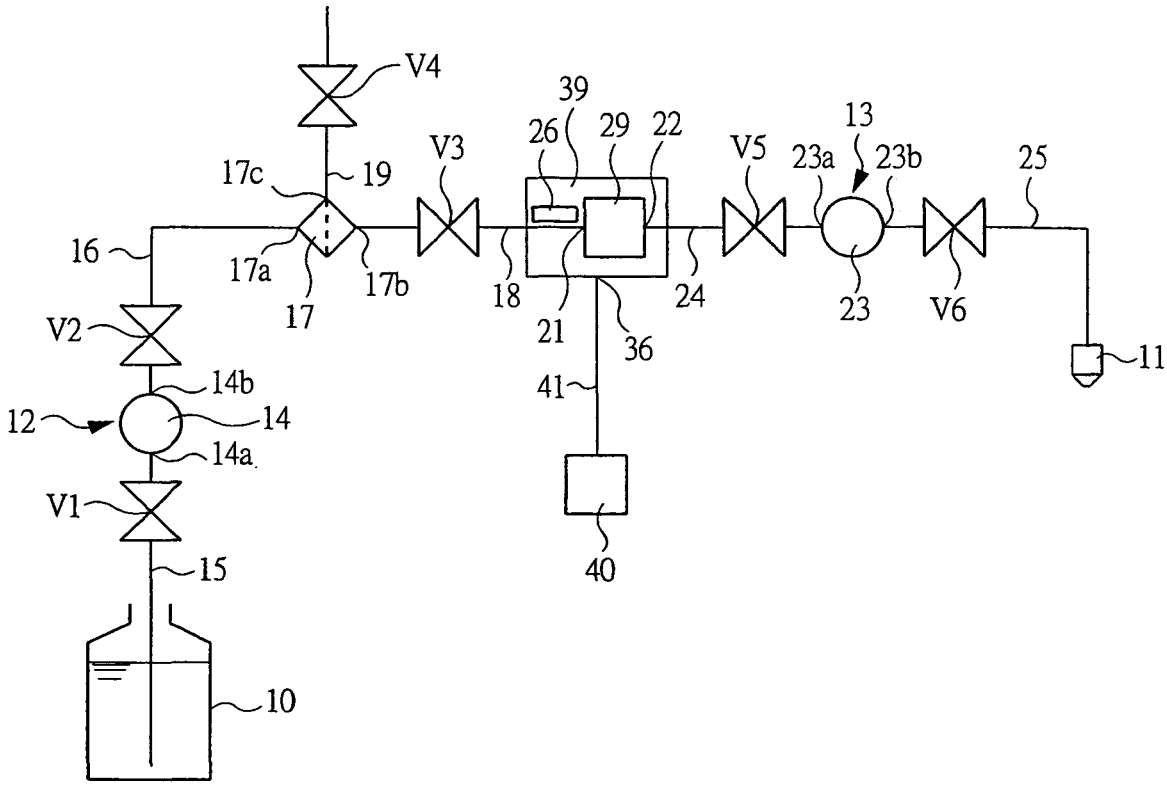
FIG. 7 is a chemical liquid circuit diagram schematically illustrating another modification example of the chemical liquid supply apparatus shown in FIG. 1A.
Figure 8:
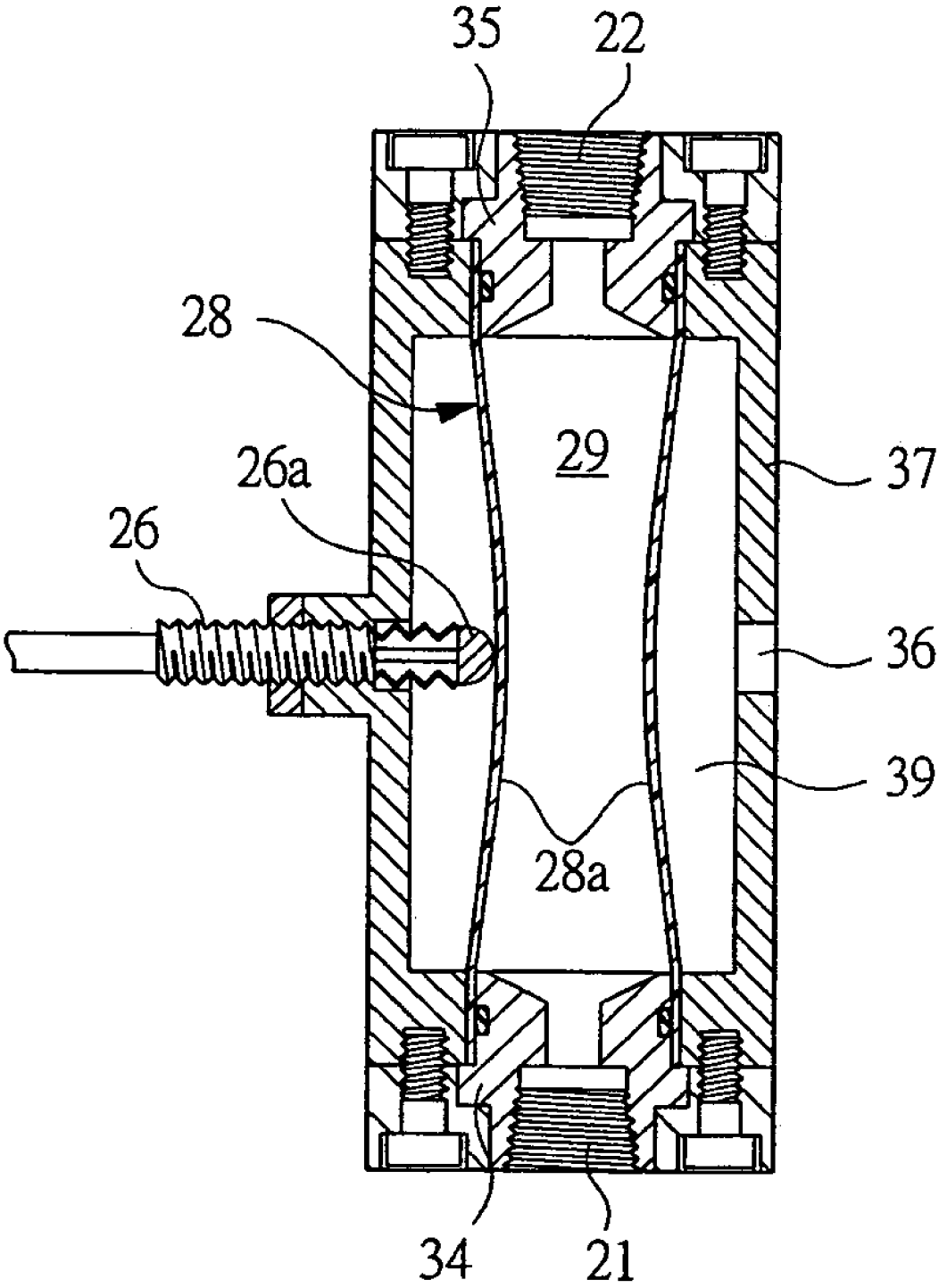
FIG. 8 is a schematic cross sectional view illustrating the inner structure of the flexible tank shown in FIG. 7.

FIG. 7 is a chemical liquid circuit diagram schematically illustrating another modification example of the chemical liquid supply apparatus shown in FIG. 1A; and FIG. 8 is a schematic cross sectional view illustrating the inner structure of the flexible tank shown in FIG. 7. The members same as that described above are denoted by the same reference numerals.

A sealing part 37 in which a pressure port 36 is formed is fixed to adaptor parts 34 and 35. The sealing part 37 and the adaptor parts 34 and 35 sections thereat so as to form a compression chamber 39, and the flexible tube 28*a* is contained in the compression chamber 39 in a manner that the tube is isolated from outside. A fluid supply source 40 is connected to the pressure port 36 via a pressure fluid channel 41; and when the fluid supply source 40 is actuated so as to supply a fluid pressure from the pressure port 36, a predetermined pressure is applied to the flexible tube 28*a* from outside. Accordingly, the pressure applied to the chemical liquid from the flexible tube 28*a* is kept constant, by supplying a fluid pressure from the fluid supply source 40 so as to balance out the pressure applied to the chemical liquid from flexible tube 28*a*, such that the pressure applied from the flexible tube 28*a* to the chemical liquid is kept constant.

Figure 9:
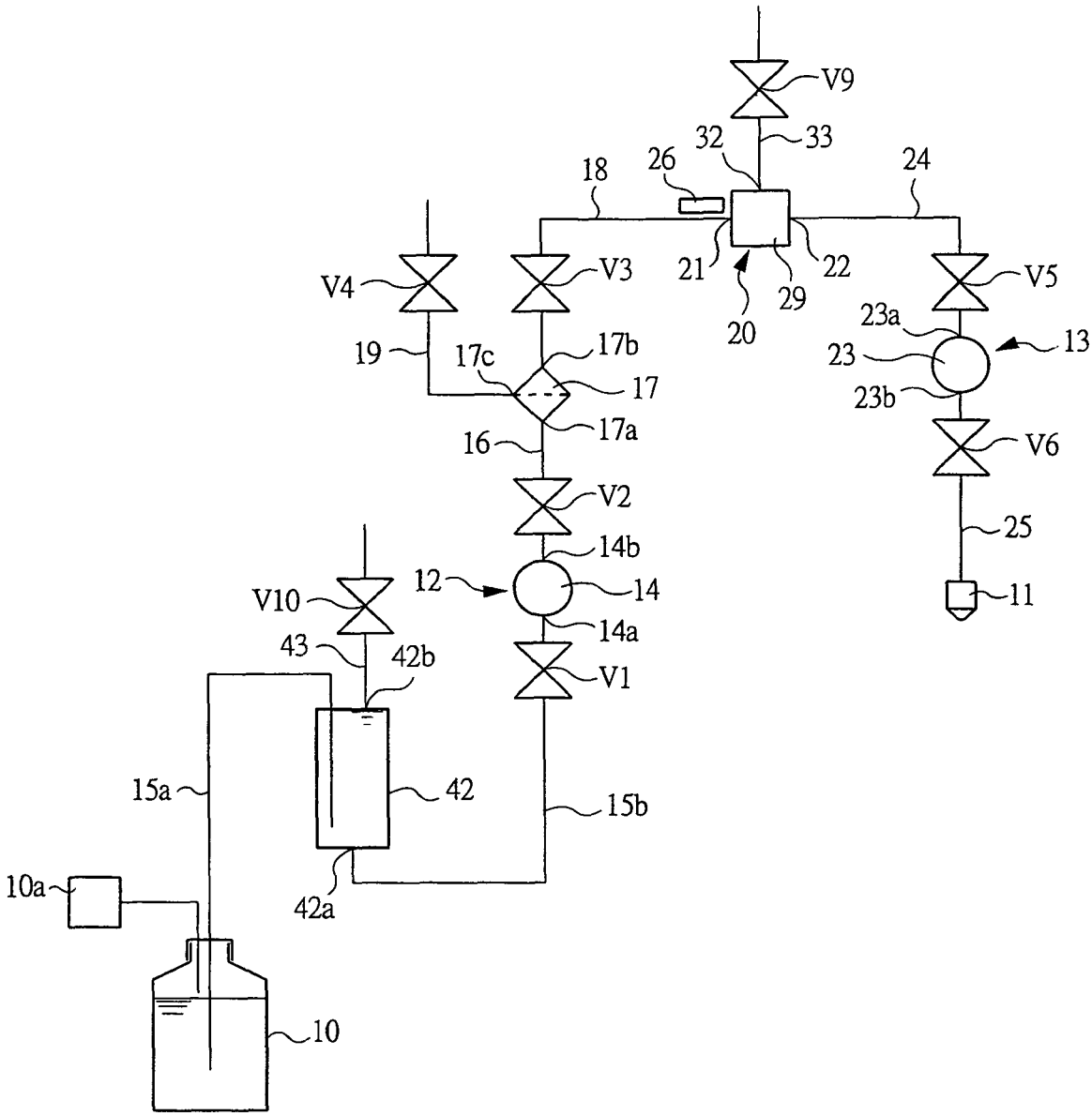
FIG. 9 is a chemical liquid circuit diagram for describing the configuration of the flexible tank.

FIG. 9 is a chemical liquid circuit diagram for describing the configuration of the flexible tank. In the illustrated case, the flexible tank 20 is placed at a position higher than the chemical liquid bottle 10, the primary-side pump 12, the filter 17, and the secondary-side pump 13. When the flexible tank 20 is placed at the highest position as described above, the gas in the circuit can be efficiently collected to the flexible tank 20, such that the gas can be discharged from the gas discharge port 32.

The chemical liquid contained in the chemical liquid bottle 10 is reduced along with usage; therefore, it has to be appropriately replaced. Herein, as a means for avoiding stoppage of the chemical liquid supply apparatus even when the empty chemical liquid bottle 10 is being replaced, a buffer tank 42 may be provided within the chemical liquid circuit, and some of the chemical liquid in the chemical liquid bottle 10 is stored therein in advance, such that the chemical liquid contained in the buffer tank 42 serving as a substitute can be supplied while the empty chemical liquid bottle 10 is being replaced.

The buffer tank 42 is a container made of resin that does not change the volume thereof. The buffer tank is disposed between the chemical liquid bottle 10 and the suction valve V1 of the primary-side pump 12, and one end of the chemical liquid introducing fluid channel 15*a* is placed inside of the buffer tank. A discharge port 42*a* is provided at the bottom of the buffer tank 42, and a chemical liquid introducing channel 15*b* is connected with the discharge port 42*a* and the pump inlet 14*a*, therebetween. An atmospheric-air open port 42*b* is provided at the upper side of the buffer tank 42. A fluid channel 43 in which an atmospheric-air open valve V10 is provided is connected to the atmospheric-air open port 42*b*, and when the primary-side pump 12 is actuated in the state that the atmospheric-air open valve V10 is closed, the chemical liquid in the chemical liquid bottle 10 flows into the primary-side pump 12 via the buffer tank 42.

The chemical liquid is caused to fill the buffer tank 42 via the chemical liquid introducing fluid channel 15*a* as long as the chemical liquid remains in the chemical liquid bottle 10. When the chemical liquid bottle 10 becomes empty, and while there performed a bottle replacement operation in which the empty chemical liquid bottle 10 is unloaded and a full chemical liquid bottle 10 is loaded, the chemical liquid in the buffer tank 42 can be supplied to the primary-side pump 12. During this process, atmospheric air comes in from the chemical liquid bottle 10 through the chemical liquid introducing fluid channel 15*a*, thereby lowering the fluid level in the buffer tank 42.

After the new chemical liquid bottle 10 is loaded, in order to fill the inside of the buffer tank 42 with the chemical liquid, a pressure device 10*a* is actuated in a state in which the atmospheric-air open valve V10 is open so as to apply a pressure to the chemical liquid in the chemical liquid bottle 10 and subject the chemical liquid in the chemical liquid bottle 10 to a compression transport toward the buffer tank 42. At this time, the gas in the buffer tank 42 is discharged to outside via the fluid channel 43. After the inside of the buffer tank 42 is filled with the chemical liquid, the compression transport of the chemical liquid by means of the pressure device 10*a* is stopped, and the chemical liquid bottle 10 is open to the atmospheric air and the atmospheric-air open valve V10 is closed. The chemical liquid can be discharged from the application nozzle 11 even when the chemical liquid bottle 10 is being replaced, by providing the buffer tank 42 in the chemical liquid circuit as described above.

Figure 10:
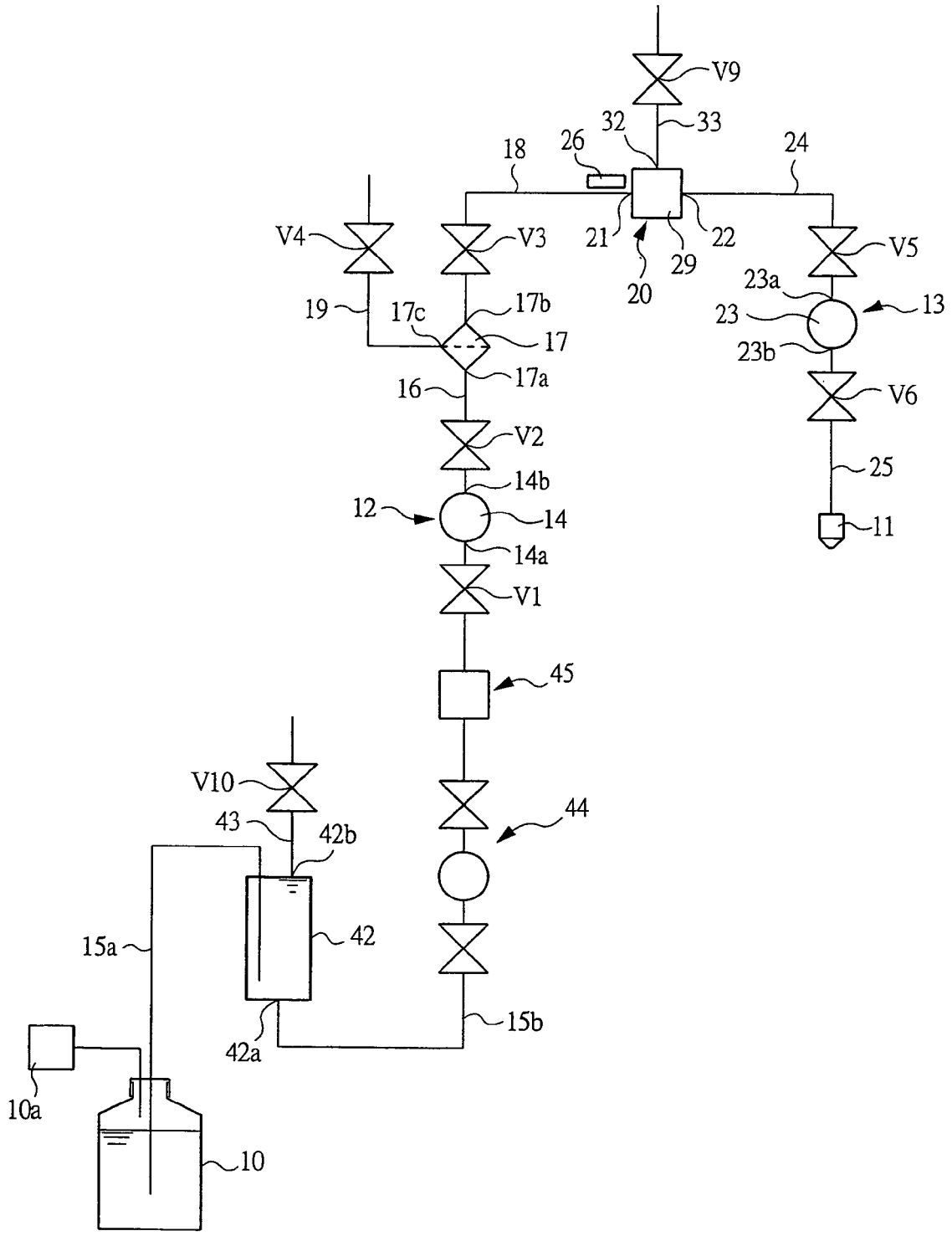
FIG. 10 is a chemical liquid circuit diagram illustrating another embodiment of the chemical liquid supply apparatus shown in FIG. 9.

FIG. 10 is a chemical liquid circuit diagram illustrating another embodiment of the chemical liquid supply apparatus shown in FIG. 9. In some cases, the application nozzle 11 is provided about several meters above the chemical liquid bottle 10 disposed at the uppermost stream side of the chemical liquid circuit. In this case, if the chemical liquid in the chemical liquid bottle 10 is updrawn only by the primary-side pump 12, the load imposed on the pump becomes excessive. In this case, as shown in FIG. 10, in addition to the primary-side pump 12, an auxiliary pump 44 for relaying is provided so as to suppress the load imposed on each pump. Herein, an auxiliary tank 45 is disposed for temporarily containing the chemical liquid updrawn by the auxiliary pump 44 until it is updrawn by a downstream pump, for example, the primary-side pump 12. As the auxiliary tank 45, the tank same as the flexible tank 20 can be employed.

Figure 11:
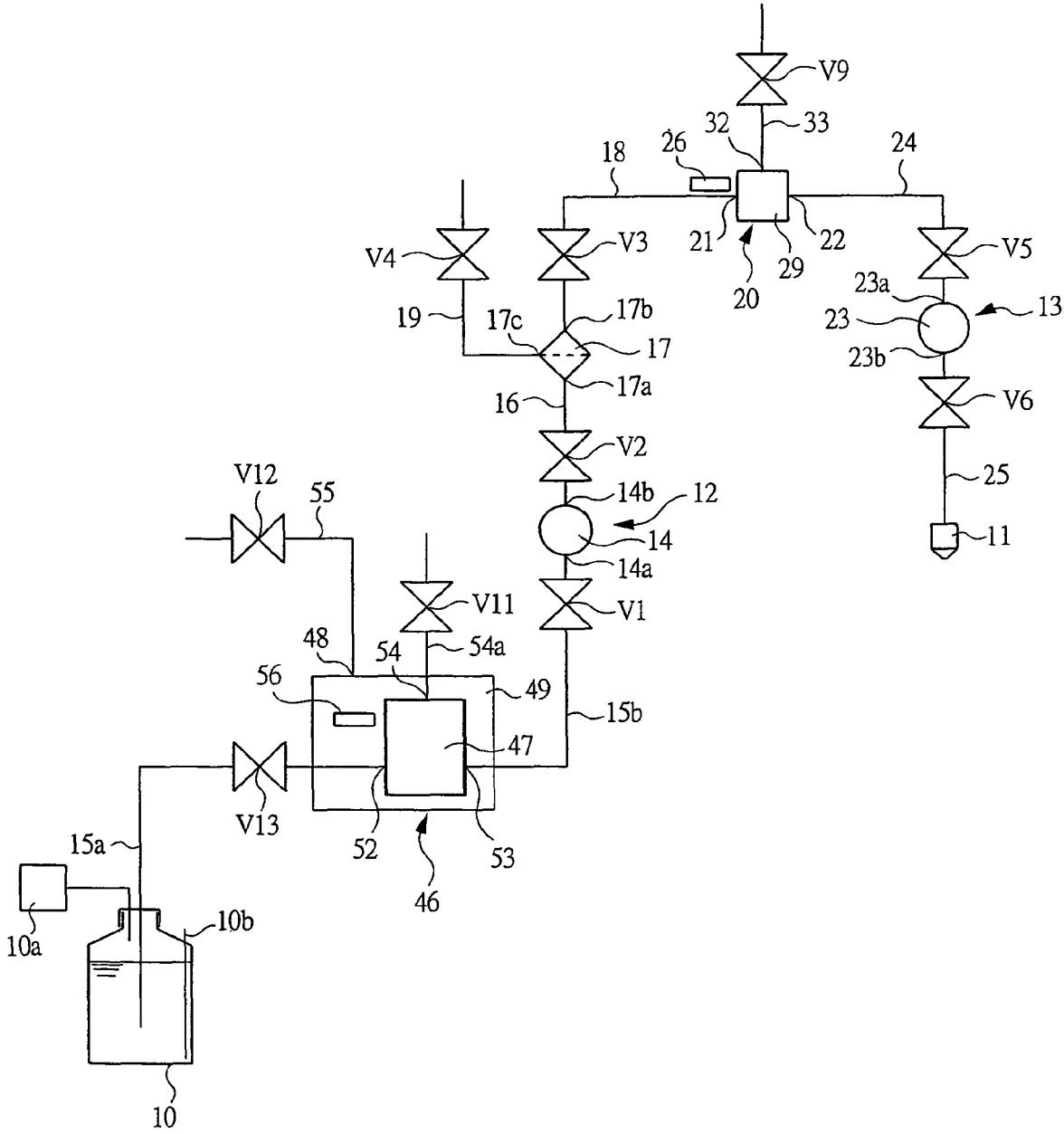
FIG. 11 is a chemical liquid circuit diagram illustrating another embodiment of the chemical liquid supply apparatus shown in FIG. 9.
Figure 12:
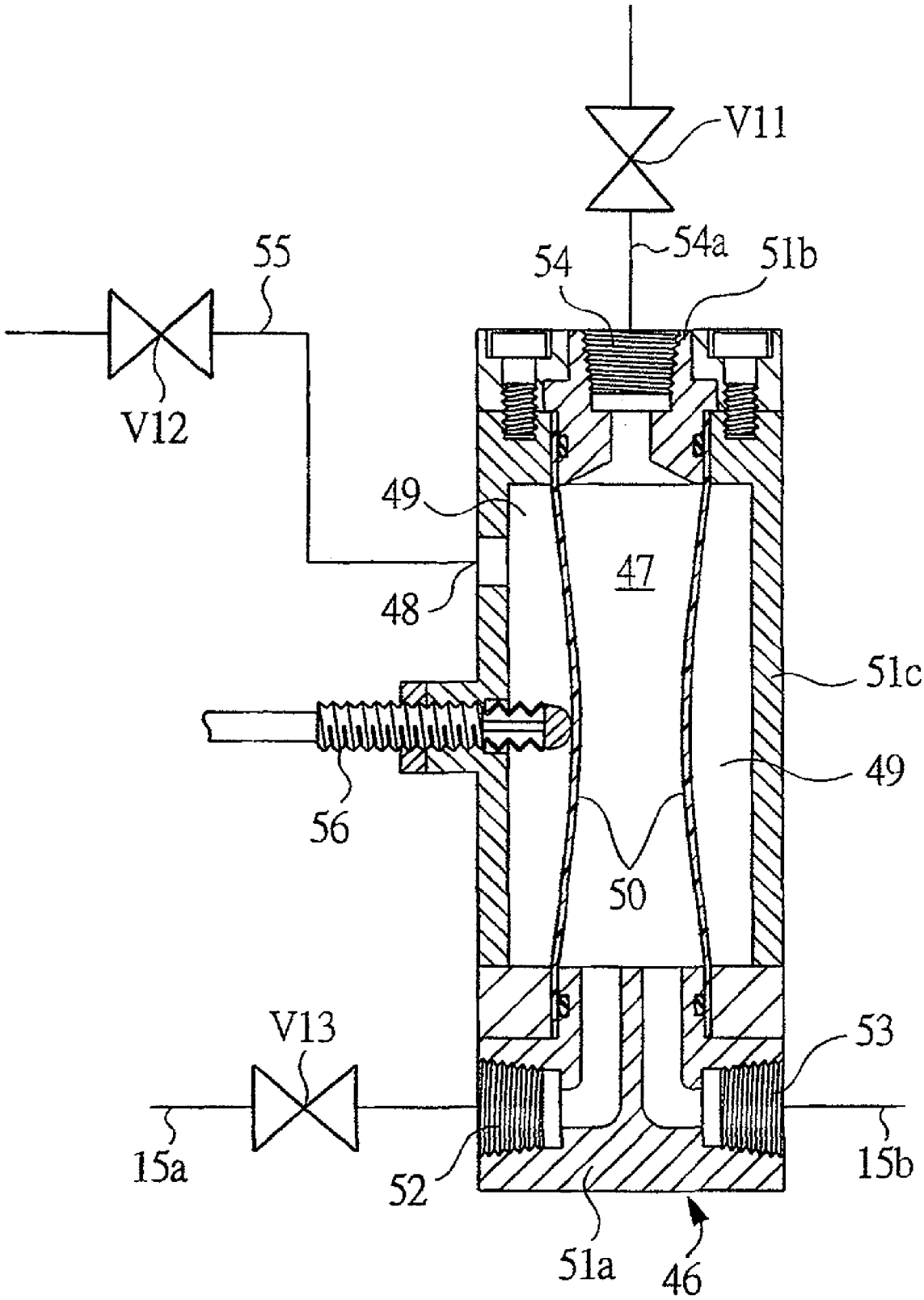
FIG. 12 is a schematic cross sectional view illustrating the inner structure of a buffer tank shown in FIG. 11.

FIG. 11 is a chemical liquid supply circuit diagram illustrating another embodiment of the chemical liquid supply apparatus shown in FIG. 9, and FIG. 12 is a schematic cross sectional view illustrating the inner structure of a buffer tank shown in FIG. 11. Herein, in FIG. 11 and FIG. 12, the members same as that described above are denoted by the same reference numerals.

As shown in FIG. 12, a buffer tank 46 has a buffer tank chamber 47 that expands in accordance with the amount of the chemical liquid supplied from the chemical liquid bottle 10 by compression transport and contracts in accordance with the amount of the chemical liquid sucked in by the primary-side pump 12, and a pressure chamber 49 accommodating the buffer tank chamber 47 and communicating with the inside and outside via an atmospheric-air open port 48.

The buffer tank chamber 47 is formed so as to be sectioned by a flexible tube 50, and adaptor parts 51*a* and 51*b* to which the flexible tube 50 is attached. One end of the flexible tube 50 is open to a gas discharge port 54 formed in the adaptor part 51*b*, and the other end of the tube is open to a primary-side port 52 and a secondary-side port 53 formed in the adaptor part 51*a*. A gas discharge fluid channel 54*a* in which a deaerating valve V11 is provided is connected to the gas discharge port 54.

The pressure chamber 49 is formed so as to be sectioned by the adaptor parts 51*a* and 51*b* and a sealing part 51*c* fixed to the adaptor parts and in which the atmospheric-air open port 48 is formed, an atmospheric-air introducing fluid channel 55 in which an atmospheric-air open valve V12 is provided is connected to the atmospheric-air open port 48. A sensor 56 for detecting the amount of the chemical liquid contained in the buffer tank chamber 47 in accordance with the deformation of the flexible tube 50 is provided in the buffer tank 46.

A selector valve V13 is provided in the chemical liquid introducing fluid channel 15*a*. A sensor 10*b* for detecting the amount of the chemical liquid contained in the chemical liquid bottle 10 is provided in the chemical liquid bottle 10, such that the timing for changing the chemical liquid bottle 10 can be checked.

The chemical liquid is caused to fill the buffer tank chamber 47 via the chemical liquid introducing fluid channel 15*a* as long as the chemical liquid remains in the chemical liquid bottle 10. When the chemical liquid bottle 10 becomes empty, and while there performed a bottle replacement operation in which the empty chemical liquid bottle 10 is unloaded and a full chemical liquid bottle 10 is loaded, the selector valve V13 may be closed such that the chemical liquid in the buffer tank chamber 47 is supplied to the primary-side pump 12. During this process, since outside air is introduced through the atmospheric-air open port 48, the flexible tube 50 contracts due to the elastic force of the tube per se, and the primary-side pump 12 performs suction, thereby reducing the volume of the buffer tank chamber 47. A pressure may be applied from the atmospheric-air open port 48.

After the new chemical liquid bottle 10 is loaded, in order to fill the inside of the buffer tank chamber 47 with the chemical liquid, a pressure device 10*a* is actuated in a state in which the atmospheric-air open valve V12 is open so as to apply a pressure to the chemical liquid in the chemical liquid bottle 10 and subject the chemical liquid in the chemical liquid bottle 10 to a compression transport toward the buffer tank chamber 47. At this time, the gas in the pressure chamber 49 is discharged to outside via the fluid channel 55. When a sensor 58 detects that the inside of the buffer tank chamber 47 is filled with the chemical liquid, the compression transport of the chemical liquid performed by the pressure device 10*a* is stopped, and the atmospheric-air open valve V12 is closed.

When the atmospheric-air open valve V12 is kept closed, the pressure in the pressure chamber 49 is kept constant, therefore contraction of the flexible tube 50 is prevented, and the volume of the buffer tank chamber 47 is kept constant. As described above, when the buffer tank 46 is provided in the chemical liquid circuit, the chemical liquid can be discharged from the application nozzle 11 even when the chemical liquid bottle 10 is being replaced. Moreover, in the case shown in FIG. 11, the chemical liquid in the buffer tank chamber 47 does not come into contact with air during the bottle replacement since the flexible tube 50 contracts, therefore, cleanliness of the chemical liquid is not deteriorated.

The present invention is not limited to the above described embodiments, and various modifications can be made without deviating from the scope of the invention. For example, in the above described embodiments, there described a case in which the chemical liquid supply apparatus is used for applying a photoresist liquid onto a wafer, however, the present invention is not limited thereto and the present invention can be applied to supply various types of liquids. Particularly, the present invention can be effectively used in the case in which a chemical liquid that can be easily altered in contact with air is filtrated through the filter 17 and discharged.

Figure 13A:
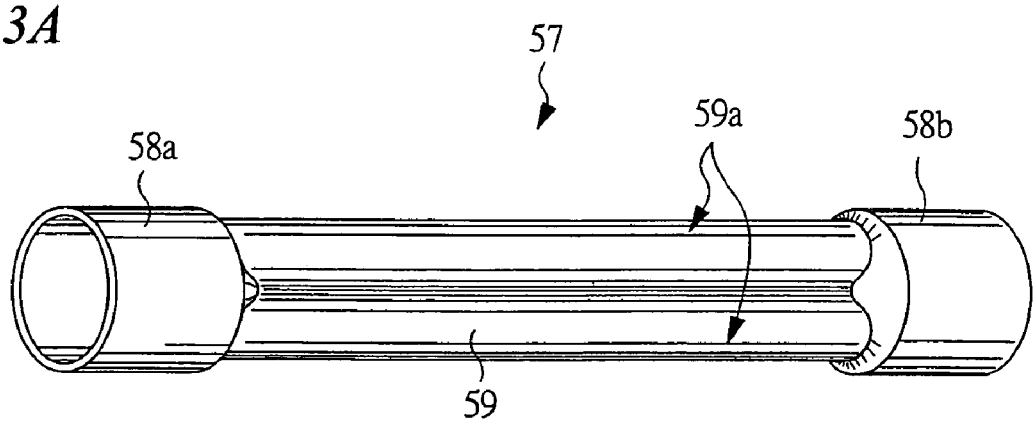
FIG. 13A is a perspective view illustrating a modification example of a flexible tube which is another embodiment.
Figure 13B:
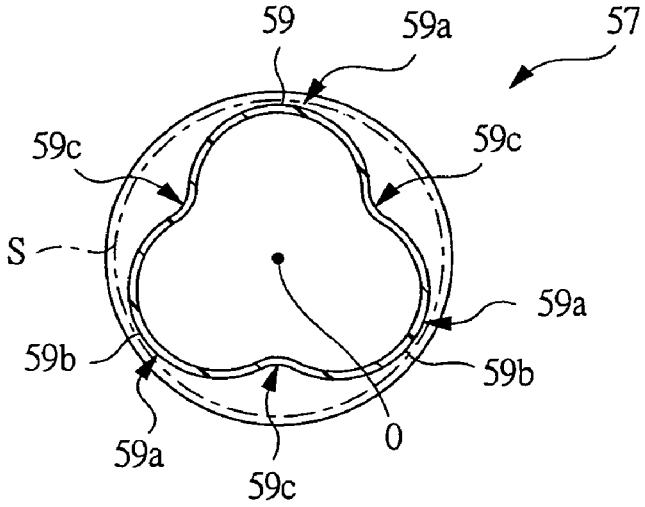
FIG. 13B is a cross sectional view illustrating an elastic deformable part in an expanded state.
Figure 13C:
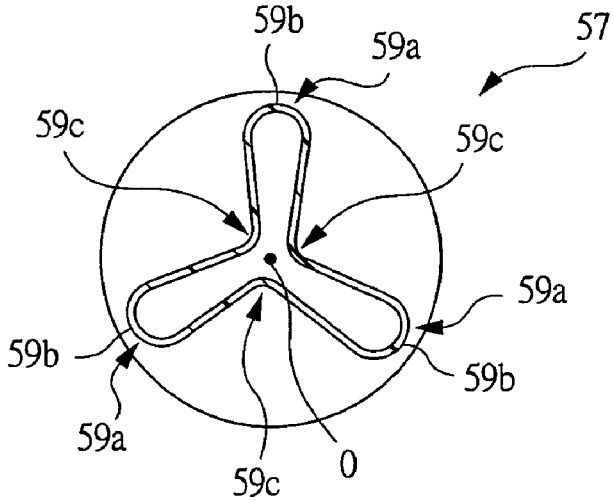
FIG. 13C is a cross sectional view illustrating the elastic deformable part in a contracted state.

The cross sectional shape of the flexible tubes 28*a* and 50 is not limited to a circular shape, and, for example, that having an irregular cross sectional shape such as that shown in FIG. 13A to FIG. 13C may be used. A flexible tube 57 has a fixed end part 58*a* at the inflow side, and a fixed end part 58*b* at the outflow side, and an elastic deformable part 59 is provided therebetween. Protruding arc-like parts 59*a* are provided in the elastic deformable part 59, and the protruding arc-like parts 59*a* are outwardly curved so as to protrude while employing three vertex parts 59*b*, respectively, which are provided so as to be equally spaced at the positions approximately every 120° in the circumferential direction, wherein the curvature of the each of the protruding arc-like parts is smaller than the curvature of a virtual circle S abutting the vertex parts 59*b* as the deformation center. At the positions mutually between the protruding arc-like parts 59*a* in the circumferential direction, recessed arc-like parts 59*c* are continued, and the recessed arc-like parts 59*c* are curved so as to be recessed with respect to the outer side.

FIG. 13B is a cross sectional view illustrating the elastic deformable part in an expanded state, and FIG. 13C is a cross sectional view illustrating the elastic deformable part in a contracted state. As shown in the drawings, when the elastic deformable part 59 is expanded or contracted, each of the protruding arc-like parts 59*a* is elastically deformed in the circumferential direction, and the recessed arc-like parts 59*c* are deformed in the radial direction. When the cross section of the elastic deformable part 59 is a shape of a trefoil as described above, the differential of the cross sectional area before and after the deformation can be increased. Therefore, the apparatus can flexibly correspond to change in the amount of the chemical liquid to be contained in the volume-variable chamber 29 or the buffer tank chamber 47, and a tank having a large maximum volume with small outside dimensions can be realized. When the part is deformed so as to be contracted, the vertex parts 59*b* are not displaced in the radial direction, and each of the protruding arc-like parts 59*a* is deformed so as to be bent in the circumferential direction with the vertex part 59*b* serving as a bending center. Therefore, the elastic deformable part 59 can be deformed without applying a large pressure to the compression chamber 39 or the pressure chamber 49. Moreover, since the force required for causing a liquid to flow in is small, the load imposed on, for example, the pumps is small.

As the suction valve V1 to the selector valve V13, for example, an electromagnetic valve actuated by an electric signal, an air-operated valve actuated by an air pressure, or a check valve may be employed.

According to the flexible tank of the present invention, the contact between the chemical liquid and air in the volume-variable chamber can be suppressed to minimum level and the chemical liquid can be stored without deteriorating its cleanliness, by containing the chemical liquid in the volume-variable chamber that is expanded and contracted. By use of the flexible tank, the amount of the chemical liquid discharged from the chemical liquid supply apparatus can be stabilized, discharge accuracy can be improved, and a product such as a semiconductor integrated circuit can be produced in a high quality and a high yield.

According to the flexible tank of the present invention, it can be checked that if a predetermined amount of the chemical liquid is contained in the volume-variable chamber, by detecting, by a sensor, deformation of the flexible membrane formed so as to section the volume-variable chamber.

According to the flexible tank of the present invention, the amount of the chemical liquid contained in the volume-variable chamber and the pressure of the chemical liquid at the flow-in time and the flow-out time toward or from the tank can be controlled with a high accuracy, by accommodating the volume-variable chamber in the compression chamber comprising the pressure port, and supplying a predetermined fluid pressure from the pressure port to the compression chamber.

According to the flexible tank of the present invention, stagnation of the chemical liquid can be reduced, by using the flexible tube of which one end being open to the primary-side port and the other end being open to secondary-side port as the flexible membrane.

According to the flexible tank of the present invention, the gas remaining in the chemical liquid can be discharged, by using the flexible tube of which one end being open to the discharge port and the other end being open to the primary-side port and secondary-side port as the flexible membrane, and disposing the gas discharge port upwardly. The discharge accuracy of the chemical liquid can be improved by discharging the gas in the chemical liquid absorbing the supply pressure.

According to the flexible tank of the present invention, a diaphragm or a bellows attached to the adaptor part so as to cover the primary-side port and the secondary-side port can be employed as the flexible membrane, and the amount of the contained chemical liquid can be detected at different levels, by disposing a plurality of sensors in the axial direction in which the flexible membrane is expanded and contracted.

According to the chemical liquid supply apparatus of the present invention, the chemical liquid can be stored without deteriorating the cleanliness thereof, by containing the chemical liquid in the buffer tank that is expanded and contracted so as to suppress the contact with air to the minimum level. By use of the buffer tank, even during replacement of the chemical liquid bottle, the chemical liquid having a high cleanliness can be stably supplied.

According to the chemical liquid supply apparatus of the present invention, the gas in the chemical liquid circuit can be efficiently collected to the flexible tank, and discharged from the gas discharge port provided in the flexible tank, by placing the flexible tank at the position higher than those of the chemical liquid bottle, the primary-side pump, the filter, and the secondary-side pump.

In the foregoing, the invention made by the inventor of the present invention has been concretely described based on the embodiments. However, it is needless to say that the present invention is not limited to the foregoing embodiments and various modifications and alterations can be made within the scope of the present invention.

What is claimed is:

1. In a chemical liquid supply apparatus having a primary-side pump and a secondary-side pump, a flexible tank comprising:

a volume-variable chamber formed by a flexible tube which is expandable and contractable in a radial direction, and two adaptor parts in which the flexible tube is attached, the volume-variable chamber temporarily containing a chemical liquid flowing from the primary-side pump to the secondary-side pump;

a primary-side port and a secondary-side port formed in at least one of the adaptor parts so as to be open to the volume-variable chamber, the primary-side and secondary-side ports being connected to the primary-side and secondary-side pumps, respectively; and a connection part connecting and fixing the adaptor parts and enclosing the flexible tube, wherein the flexible tube has an elastic deformable part comprising, in both fully-expanded and contracted conditions:

protruding arc-like parts, which have three vertex parts spaced approximately evenly in a circumferential direction and serving as deformation centers, the protruding arc-like parts being outwardly curved so as to protrude and so that each of the protruding arc-like parts is smaller in curvature than a virtual circle circumscribing all and abutting each of the vertex parts; and recessed arc-like parts located inwardly of and between the protruding arc-like parts and joined consecutively with the respective protruding arc-like parts to form a closed deformable shape, and wherein each of the protruding arc-like parts in the flexible tube is elastically deformed in the circumferential direction, each of the recessed arc-like parts therein is elastically deformed in a radial direction, and the flexible tube expands in accordance with a volume of the chemical liquid flowing in from the primary-side port, and contracts in accordance with a volume of the chemical liquid flowing out from the secondary-side port.

2. The flexible tank according to claim 1, wherein deformation of the flexible tube, which deformation is an expansion or a contraction, is detected by a sensor so as to determine that a predetermined amount of the chemical liquid is contained in the volume-variable chamber.

3. The flexible tank according to claim 1, wherein the connection part defines a compression chamber in which the volume-variable chamber is accommodated, a pressure port is provided in the connection part, and a predetermined fluid pressure is supplied from the pressure port to the compression chamber.

4. The flexible tank according to claim 1, wherein a gas discharge port open to the volume-variable chamber is formed in one of the adaptor parts, and one end of the flexible tube is open to the gas discharge port and the other end of the flexible tube is open to the primary-side port and the secondary-side port formed in the other of the adaptor parts.

5. The flexible tank according to claim 1, wherein a diaphragm or a bellows attached to one of the adaptor parts so as to cover the primary-side port and the secondary-side port is used as the flexible tube.

6. A chemical liquid supply apparatus having a chemical liquid bottle containing a chemical liquid, and a pump for sucking in the chemical liquid contained in the chemical liquid bottle and supplying the chemical liquid to an application nozzle, the chemical liquid supply apparatus comprising:

a buffer tank chamber expandable in accordance with the amount of the chemical liquid supplied from the chemical liquid bottle by compression transport, and contractable in accordance with the amount of the chemical liquid sucked in by the pump;

a pressure chamber containing the buffer tank chamber and communicated with inside and outside via an atmospheric-air open port, the atmospheric-air open port being formed at the pressure chamber; and a pressure device actuated after replacement of the chemical liquid bottle to apply a pressure to a chemical liquid contained in a replaced chemical liquid bottle and fill the buffer tank with the chemical liquid, wherein the volume of the buffer tank chamber is kept constant as the chemical liquid is supplied through the buffer tank chamber in a state in which the atmospheric-air open port is closed, and the buffer tank chamber is expanded or contracted in accordance with the amount of the contained chemical liquid in a state in which the atmospheric-air open port is open, whereby the chemical liquid can be discharged from the application nozzle even when the chemical liquid bottle is being replaced.

7. A chemical liquid supply apparatus having a chemical liquid bottle containing a chemical liquid, a primary-side pump for sucking in the chemical liquid contained in the chemical liquid bottle, a filter for filtrating the chemical liquid sucked-in by the primary-side pump, and a secondary-side pump for supplying the chemical liquid filtrated through the filter to an application nozzle, the chemical liquid supply apparatus comprising:

an adaptor part in which a primary-side port connected to the primary-side pump and a secondary-side port connected to the secondary-side pump are formed; and a flexible tank attached to the adaptor part and comprising a flexible tube being expanded in accordance with the amount of the chemical liquid flowing in from the primary-side port, and being contracted in accordance with the amount of the chemical liquid flowing out from the secondary-side port, wherein a gas discharge port is formed in the adaptor part, the flexible tube is attached to the adaptor part such that one end of the tube is open to the gas discharge port and other end is open to the primary-side port and the secondary-side port, and the flexible tank is placed higher than the chemical liquid bottle, the primary-side pump, the filter, and the secondary-side pump such that the gas discharge port is upwardly positioned, wherein the flexible tube has an elastic deformable part comprising, in both fully-expanded and contracted conditions:

protruding arc-like parts, which have three vertex parts spaced approximately evenly in a circumferential direction and serving as deformation centers, the protruding arc-like parts being outwardly curved so as to protrude and so that each of the protruding arc-like parts is smaller in curvature than a virtual circle abutting each of the vertex parts; and recessed arc-like parts located inwardly of and between the protruding arc-like parts and joined consecutively with the respective protruding arc-like parts to form a closed deformable shape, and wherein each of the protruding arc-like parts in the flexible tube is elastically deformed in the circumferential direction, each of the recessed arc-like parts therein is elastically deformed in a radial direction, and the flexible tube expands in accordance with a volume of the chemical liquid flowing in from the primary-side port, and contracts in accordance with a volume of the chemical liquid flowing out from the secondary-side port.

8. The chemical liquid supply apparatus according to claim 7, further comprising:

a buffer tank chamber expandable in accordance with the amount of the chemical liquid supplied from the chemical liquid bottle by compression transport, and contractable in accordance with the amount of the chemical liquid sucked-in by the primary-side pump; and a pressure chamber accommodating the buffer tank chamber and communicating with inside and outside via an atmospheric-air open port, wherein the volume of the buffer tank chamber is kept constant in a state in which the atmospheric-air open port is closed, and the buffer tank chamber is expanded or contracted in accordance with the amount of the contained chemical liquid in a state in which the atmospheric-air open port is open.

9. A chemical liquid supply apparatus comprising:

a chemical liquid bottle containing a chemical liquid;

a primary-side pump for sucking in the chemical liquid contained in the chemical liquid bottle;

a filter for filtrating the chemical liquid sucked-in by the primary-side pump;

a secondary-side pump for supplying the chemical liquid filtrated through the filter to an application nozzle; and a flexible tank, wherein the flexible tank includes a volume-variable chamber formed so as to be sectioned by a flexible tube and two adaptor parts in which the flexible tube is attached, a primary-side port and a secondary-side port being formed in at least one of the adaptor parts so as to be open to the flexible tube, and a compression chamber enclosing the flexible tube and connecting the adaptor parts, a pressure port being formed in the compression chamber, whereby the flexible tube is expandable in accordance with an amount of the chemical liquid flowing in from the primary-side port, and is contractable in accordance with an amount of the chemical liquid flowing out from the secondary-side port, and a predetermined fluid pressure is supplied from the pressure port to the volume-variable chamber via the compression chamber, wherein the flexible tube has an elastic deformable part comprising, in both fully-expanded and contracted conditions:

protruding arc-like parts, which have three vertex parts spaced approximately evenly in a circumferential direction and serving as deformation centers, the protruding arc-like parts being outwardly curved so as to protrude and so that each of the protruding arc-like parts is smaller in curvature than a virtual circle abutting each of the vertex parts; and recessed arc-like parts located inwardly of and between the protruding arc-like parts and joined consecutively with the respective protruding arc-like parts to form a closed deformable shape, and wherein when the flexible tube expands or contracts, each of the protruding arc-like parts in the flexible tube is elastically deformed in the circumferential direction, and each of the recessed arc-like parts therein is elastically deformed in a radial direction.

* * * * *